US006777859B1

(12) United States Patent
Arnold

(10) Patent No.: US 6,777,859 B1
(45) Date of Patent: Aug. 17, 2004

(54) LIGHT SOURCE

(75) Inventor: Jörg Arnold, Heidelberg (DE)

(73) Assignee: IP2H AG, Bern (CH)

( * ) Notice: Subject to any disclaimer, the term of this patent is extended or adjusted under 35 U.S.C. 154(b) by 0 days.

(21) Appl. No.: 10/069,140

(22) PCT Filed: Mar. 24, 2000

(86) PCT No.: PCT/DE00/00911

§ 371 (c)(1),
(2), (4) Date: Feb. 22, 2002

(87) PCT Pub. No.: WO01/15206

PCT Pub. Date: Mar. 1, 2001

(30) Foreign Application Priority Data

Aug. 22, 1999 (DE) ..... 199 39 903
Oct. 8, 1999 (DE) ..... 199 48 420

(51) Int. Cl.[7] ..... H01K 1/02
(52) U.S. Cl. ..... 313/315; 313/578
(58) Field of Search ..... 313/315, 578, 313/580, 635, 345, 15; 315/211

(56) References Cited

U.S. PATENT DOCUMENTS 4,163,171 A * 7/1979 Wurster ..... 313/579
4,176,293 A 11/1979 Giebeler
4,196,368 A * 4/1980 Hauer ..... 313/345
5,493,167 A * 2/1996 Mikol et al. ..... 313/25
6,018,216 A * 1/2000 McIntosh ..... 313/315
6,268,685 B1 * 7/2001 Stark et al. ..... 313/112

FOREIGN PATENT DOCUMENTS

| | | |
|---|---|---|
| DE | 141 222 A | 4/1980 |
| EP | 0 034 512 A2 | 8/1981 |
| JP | 05 258730 A | 10/1993 |

* cited by examiner

*Primary Examiner*—Vip Patel
*Assistant Examiner*—Glenn Zimmerman
(74) *Attorney, Agent, or Firm*—Alston & Bird LLP

(57) ABSTRACT

A light source, in particular incandescent lamp, with a bulb (1), and filament (2) arranged in the bulb (1), and a heating device (3) for the filament (2), the filament (2) emitting both visible light and heat radiation, is designed and constructed with respect to a high conversion efficiency between electric power and visible light output such that the heating device (3) includes a heating element (4) for the indirect heating of the filament (2).

18 Claims, 2 Drawing Sheets

LIGHT SOURCE

BACKGROUND OF THE INVENTION

The invention relates to a light source, in particular incandescent lamp, with a bulb, a filament arranged in the bulb, and a heating device for the filament, the filament emitting both visible light and heat radiation.

Light sources of the described type have been known from practice for a long time, and they exist in a large variety of designs and sizes. In this connection, for example, incandescent lamps are known as electrical light sources, in which it is common to bring a tungsten filament by electrical Joule heat to a highest possible temperature. In this process, a temperature radiation is generated. The light yield of incandescent filaments considerably increases as the temperature rises. Besides that, also so-called nonthermal sources of radiation are known, for example, discharge lamps, such as inert gas-, mercury-, sodium-, and metal halide discharge lamps in high-pressure and low-pressure designs.

All so far known, electrically operated types of light sources have the disadvantage that they are very inefficient with respect to converting electric power into visible light output. The conversion barely exceeds 30%. The largest portion of the consumed electric power is an uneconomical dissipation primarily in the form of heat.

A possibility of increasing the efficiency of known light sources consists in that the heat radiated from the filament or glow wire, is reflected from the inner side of the bulb back to the filament or glow wire. As a result, the filament or glow wire undergoes a kind of backheating. This results in that after reaching the same filament temperature, less electric power will be needed than during a heating without reflection. The visible light output, which is transmitted through the bulb, remains in this instance the same. In the ideal case, only that electric power will be needed, which corresponds to the visible, emitted light output and to the thermal dissipation, which is absorbed by the bulb. Thus, the conversion efficiency is improved by the portion of the reflected heat radiation. Theoretically, it would be possible to increase with that the conversion efficiency to as much as 75% or 140 lumens/watt, if one took as a basis the standard thermal dissipation of tungsten lamps of about 25%, and if one neglected the radiation absorption of a mirror coating on the inner side of the bulb. In this connection, for example, dielectric mirror coatings have an absorption of typically 0.1%.

In the case of a mirror coating on the inner side of the bulb with a reflecting power of, for example, 99.9%, statistically, every one thousandth photon in the material of the mirror coating will be absorbed. In the case of a reflection of the radiation into the bulb, the photon flux may therefore undergo only 1000 reflections on the inner side of the bulb, until it is totally absorbed in the bulb. The probability that on its path of reflection, the photon flux strikes the filament or glow wire and is there absorbed, is proportionate to the ratio of the filament volume or the filament surface to the reflecting bulb volume or the reflecting bulb surface.

To achieve a highest possible backheating of the filament, it will therefore be advantageous, when a large filament surface is present, so that the photon flux strikes the filament and is there absorbed after the fewest possible reflections on the inner side of the bulb.

However, in this instance, it is disadvantageous that in the case of an enlarged filament surface, the electrical resistance of the filament becomes smaller, so that for reaching the filament temperature necessary for the light emission, a substantially greater current is needed in the filament than in the case of a normal filament surface or normal filament cross section. This may lead to safety problems for the user of the light source. In summary, there is a dilemma as to a largest possible filament surface and the therefor required and disadvantageous high currents.

It is therefore an object of the present invention to describe a light source of the initially described type, which allows to achieve a high conversion efficiency with simple means and in a reliable manner.

SUMMARY OF THE INVENTION

The foregoing object is achieved by a light source which is designed and constructed such that the heating device includes a heating element for an indirect heating of the filament.

In accordance with the invention, it has been recognized that the development of a separate heating element for the filament accomplishes the foregoing object in a surprisingly simple manner. In this instance, the filament is indirectly heated by the heating element, which offers the great advantage that the filament may be configured irrespective of its electrical resistance behavior. As a result, it is possible to realize a large-surface filament, which exhibits a high absorptive power for heat radiation, which is reflected from the inner side of the bulb. The device, which is needed for heating the filament may be realized independently of the configuration of the filament. Consequently, it is also possible to realize a heating device, which operates with electric currents, which can be safely managed. An electrical contact between the heating device and the filament is no longer needed.

Thus, the light source of the present invention denotes a light source, which allows to achieve a high conversion efficiency with simple means and great reliability.

As regards a most favorable possible absorption behavior for heat radiation, it would be possible to design and construct the filament in the form of a strip, or, quite generally, as a flat filament. As an alternative thereto, one could also make the filament, quite generally, as a volume filament, i.e., a filament, which occupies a spatial volume, or comprises a volume. In particular, one could make the filament in the shape of a cup or cylinder jacket. In this connection, a configuration as a complete cylinder jacket or even as a portion thereof, in particular a cylinder jacket half is possible. In the case of a substantially complete cylinder jacket, such a jacket could also be made open on its side or axially slotted. This is favorable with respect to the thermal expansion behavior of the filament.

To guarantee a particularly effective absorption of the heat radiation being reflected from the inner side of the bulb, the diameter of the cylinder jacket, or of a portion or half thereof, could be only slightly smaller than the diameter of the bulb. In particular in this instance, it would be possible to arrange the filament in the bulb in concentric and/or coaxial relationship with a longitudinal axis of the bulb.

Depending on its configuration, the filament could divide the interior of the bulb into one or more half spaces or subspaces.

The bulb could have such a large outer surface that it is possible to dissipate the surface heat, which is generated, for example, by absorption of heat radiation, with the use of convection cooling or any other forced cooling. The size and form of the filament and the bulb could adapted to each other in a corresponding manner.

Basically, the filament could contain tungsten, and/or rhenium, and/or tantalum, and/or zirconium, and/or niobium. In this connection, adjustments are to be made to the respective needs of the light source characteristics. The filament could contain the last-mentioned materials in a sintered form.

Furthermore, the filament could be composed at least in part of a nonmetal. This could improve the mechanical stability of the filament.

With respect to very high surface temperatures, and very high light currents in the visible range, the filament could be composed at least in part of tantalum carbide, and/or rhenium carbide, and/or niobium carbide, and/or zirconium carbide. This would allow to reach surface temperatures, which are higher than is normal for known tungsten filament lamps.

Concretely, the heating element could be an incandescent element that is heated by the electric current. The filament is heated by the heat radiation of the incandescent element. The incandescent element may be adapted to the required lamp output independently of the filament. In a particularly simple manner, the incandescent element could be a heating coil.

As regards a particularly favorable heating of the filament by the incandescent element, the latter could be arranged within a space or half space formed by the filament, preferably within a cylinder jacket or a cylinder jacket half. In this connection, quasi the largest portion of the heat radiated from the incandescent element is absorbed by the filament. When the filament is designed as a body that is open in sections—for example, as a cylinder jacket half—the incandescent element will be able to contribute in addition to the generation of light. In this instance, the incandescent element radiates in the direction, which is predetermined by the configuration of the filament. The light source would be able to emit light already before the filament is heated to the temperature necessary for the light emission. A time delay between the activation of the light source and light emission is thus largely avoided.

In a particularly simple manner, the incandescent element could be formed from tungsten. In this instance, the use of conventional tungsten heating coils is possible.

In a constructionally very simple manner, the filament could be attached to a power supply conductor for the heating element or incandescent element, thereby avoiding additional holding means for the filament in the bulb.

As an alternative or in addition to a heating of the filament by means of a heated incandescent element, one could arrange magnetic inductors in the bulb or outside thereof for an indirect heating of the filament. Likewise with that, an indirect heating of the filament is possible in a simple manner.

To optimize the reflection behavior of the inner side of the bulb, which is transparent for the visible light, the bulb could have a mirror coating on its inner side. In a particularly favorable manner, same could be a dielectric multilayer coating. With that, a spectrally selective mirror coating is present, which largely reflects the portion of heat radiation and transmits the portion of visible radiation.

In the case of a filament, which does not fully surround an incandescent element, heat radiation is also emitted from the incandescent element directly to the inner side of the bulb. From this inner side, the heat radiation in turn is reflected on the filament.

Likewise, the heat radiation emitted from the filament is reflected from the inner side of the bulb, and thus contributes to the backheating of the filament. As a whole, the light source of the present invention could be described a radiation furnace lamp, wherein the bulb forms an internally heated radiation furnace for the infrared radiation.

The large, possible surface of the filament permits constructing light sources with high light outputs. It is likewise possible to adjust the color temperature of the light source independently of the surface temperature of the filament or incandescent element. This may occur by the spectrally selective mirror coating, which is capable of predetermining the transmitted spectral distribution of the radiation output emitted from the bulb and thus the color temperature.

In comparison with previous light sources of the same light output, it is possible to lower in particular the surface temperature of both the incandescent element and the filament, inasmuch as, on the one hand, the entire radiation output of the incandescent element must correspond only to the sum of the visible radiation output and the thermal dissipation power of the light source. However, same is smaller by the portion of reflected and reabsorbed heat radiation or portion of the infrared radiation output than the total radiation output of comparable temperature radiators of the art. In accordance with the Stefan-Boltzmann law, the total specific heat radiation is a function of the temperature, so that the incandescent element of the light source according to the invention can be operated at a lower temperature in comparison with the directly heated filament of comparable thermal light sources of the art. On the other hand, likewise for comparison, the surface temperature of the filament may be adjusted lower, since the comparable visible light current can be generated by a larger and colder surface of the filament. In this connection, the filament surface forms a new, additional constructional degree of freedom.

While it is possible to operate the filament at a relatively low temperature, and while with that also a relatively low evaporation of the filament material is reached, a disturbing evaporation may occur because of the very large surface, which is as close as possible to the inner side of the bulb. As a result of filament material, which has evaporated and settled on the inner side of the bulb, the reflectivity of the inner side of the bulb or the mirror coating on the inner side of the bulb is reduced, and the absorption of the bulb or the mirror coating and the thermal dissipation respectively are increased. It is therefore desirable to minimize the evaporation of the filament material to the greatest extent.

For minimizing the evaporation of the filament material, the bulb could contain an inert gas and/or a halogen gas, with the halogen gas containing bromine and/or iodine. With that, it would be possible to generate a normal tungsten iodide circulation in the case of a tungsten filament.

An alternative solution to the evaporation problems could occur by coating the filament and/or the incandescent element with a coating material, which has a higher melt point than the material of the filament and/or incandescent element. This lies in the dependency of the temperature-dependent vapor pressure of a solid from its melt point. Furthermore, the deposit of the coating material could exhibit a lesser absorptivity than the deposit of the standard filament material or the material of the incandescent element. As a coating material with a very high melt point, it would be possible to use, for example, tantalum carbide, and/or rhenium carbide, and or niobium carbide, and/or zirconium carbide.

As a result of the constructionally necessitated large filament surface, it is possible to generate very high light currents and to emit them from the light source, so as to enable an illumination of large building interiors or outdoor areas with only one light source according to the invention.

There exist various possibilities of improving and further developing the teaching of the present invention in an advantageous manner. To this end, one may refer to the following detailed description of a preferred embodiment with reference to the drawing. In conjunction with the detailed description of the preferred embodiment of the invention with reference to the drawing, also generally preferred improvements and further developments of the teaching are described.

DETAILED DESCRIPTION OF THE PREFERRED EMBODIMENTS

Figure 1:
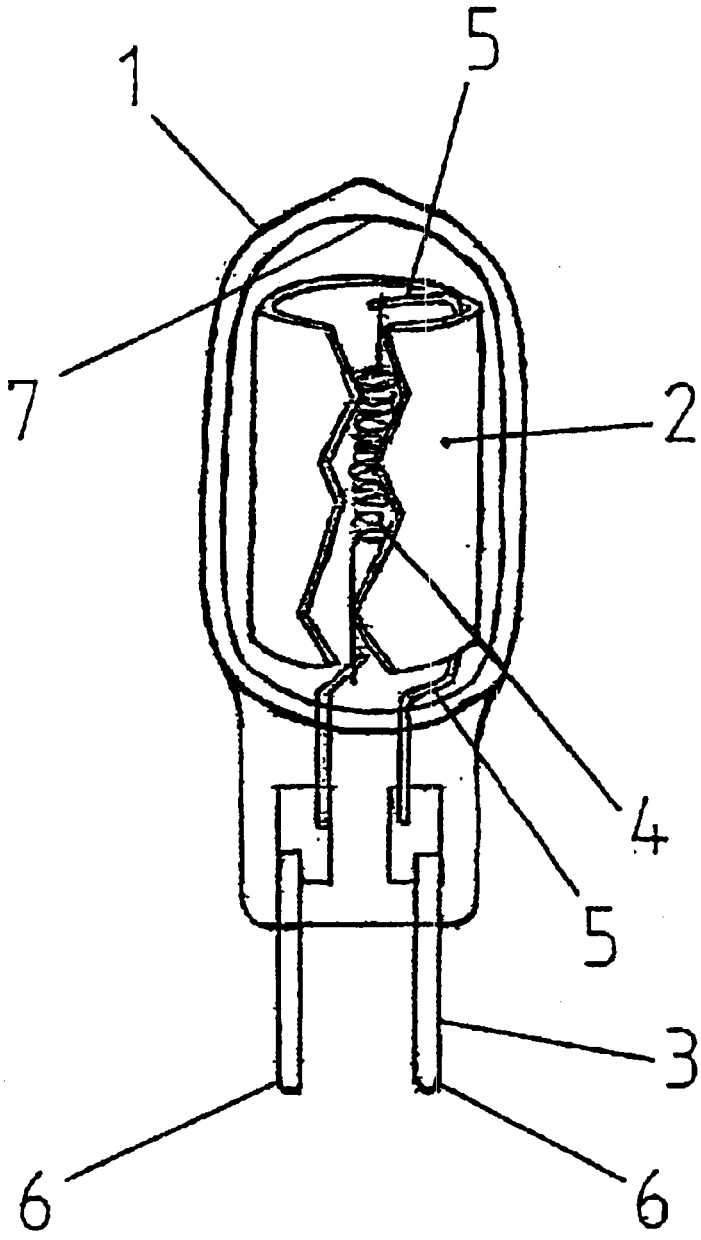
FIG. 1 is a perspective side view of the embodiment of a light source according to the invention.

FIG. 1 is a perspective side view of an embodiment of a light source according to the invention. The light source is designed and constructed as an incandescent lamp, which comprises a bulb 1 that accommodates a filament 2. For heating the filament 2, a heating device 3 is provided, which provides an electric current. The heated filament 2 emits both visible light and heat radiation. The temperature of the heated filament 2 can be about 3,000 degrees Celsius.

With respect to a high conversion efficiency and a reliable operation of the light source, the heating device 3 includes a heating element 4 for indirectly heating the filament 2. The heating element 4 is an incandescent element in spiral form, and may consist, for example, of tungsten. The filament 2 is realized substantially in the shape of a cylinder jacket, and therefor has a large absorption surface for a radiation of heat, which is reflected from the inner side of bulb 1. As a result, the filament 2 is effectively backheated by the reflected heat radiation. This makes it possible to select a lower temperature of the heating element 4 than would be necessary in the case of a conventional light source with the same light output. Consequently, it is possible to operate the light source of the present invention with lesser energy and thus more economically than conventional light sources.

Figure 3:
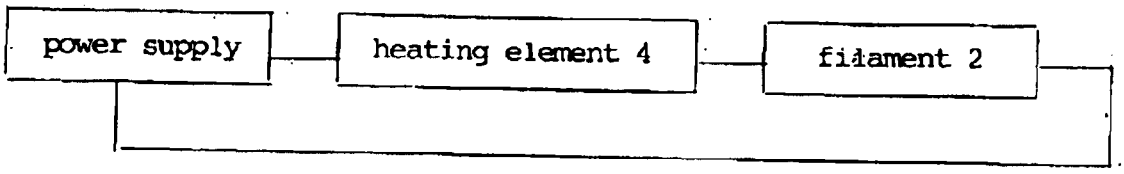
FIG. 3 is a schematic circuit diagram illustrating the series connection of the heating element and filament to the power supply.

The filament 2, which is in the form of a cylinder jacket, is attached in a simple manner to a power supply conductor 5 and in series with the heating element 4 as illustrated in FIG. 3. The heating element 4 or incandescent element in the form of a spiral is positioned in concentric and coaxial relationship with the filament 2. The filament 2 in turn is arranged in the bulb 1 in concentric and coaxial relationship with quasi tubular bulb 1. The filament 2 having the shape of a cylinder jacket or tube is made from tungsten.

In the lower end of bulb 1, electrical contacts 6 are provided for supplying a current. The electrical contacts 6 are fused together with the lower end of bulb 1.

The diameter of filament 2 is only slightly smaller than the diameter of bulb 1.

The inner side of bulb 1 is provided with a mirror coating 7. The mirror coating 7 is used for an effective reflection of the heat radiation that is emitted from heating element 4 and/or filament 2.

The heating element 4 and/or the filament 2 could include a coating of a material with a very high melt point. This would allow to reduce an evaporation of filament material and/or heating element material.

Figure 2:
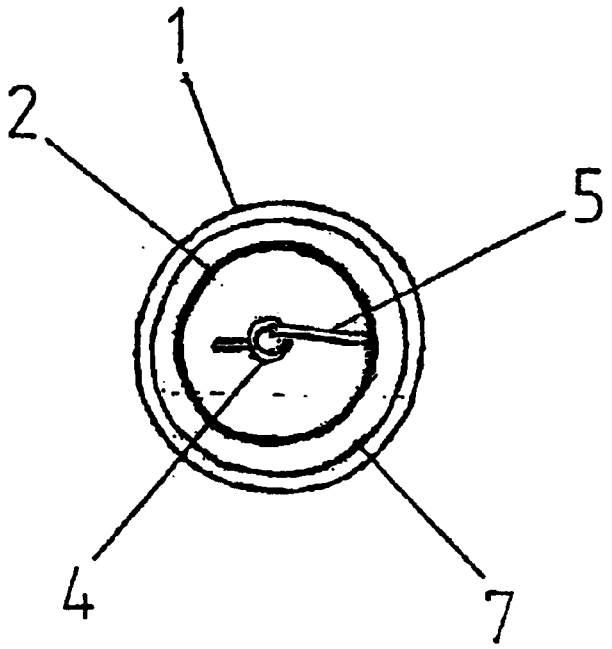
FIG. 2 is a top view of the embodiment of FIG. 1.

FIG. 2 is a top view of the embodiment of FIG. 1. As best seen in this Figure, the filament 2 is arranged in bulb 1 in substantially concentric relationship, and the heating element 4 is positioned in filament 2 substantially in the center thereof.

As regards further advantageous improvements and further developments of the teaching in accordance with the invention, the general part of the description on the one hand and the attached claims on the other are herewith incorporated by reference.

Finally it should be expressly emphasized that the foregoing, merely arbitrarily selected embodiment is used only for explaining the teaching of the present invention, without however limiting same to this embodiment.

What is claimed is:

1. A light source comprising a bulb, a filament mounted within said bulb and which has an arcuate configuration when viewed in plan so as to define a space within the bulb which is at least partially enclosed by the filament, an electrical heating device for heating the filament whereby the filament can be heated to cause the emission of visible light and heat radiation, said heating device including an incandescent heating element positioned within said space for indirectly heating the filament, and wherein said heating device further comprises an electrical circuit connecting the filament and the heating element in series.

2. The light source of claim 1 wherein said heating device further includes a pair of electrical contacts which are electrically connected to said heating element.

3. The light source of claim 1 wherein said filament is in the form of at least a portion of a cylindrical jacket.

4. The light source of claim 3 wherein the at least a portion of a cylindrical jacket includes a lengthwise extending opening.

5. The light source of claim 3 wherein the at least a portion of a cylindrical jacket extends for at least 180° when viewed in plan and defines a diameter which is only slightly smaller than a diameter defined by the bulb.

6. The light source of claim 1 wherein the bulb defines a longitudinal axis, with the filament being configured so define a coaxial center axis.

7. The light source of claim 1 wherein the bulb defines a longitudinal axis and wherein the heating element is in the form of a helical coil which is disposed coaxially along the longitudinal axis.

8. The light source of claim 1 wherein the filament comprises a sintered metal selected from the group consisting of tungsten, rhenium, tantalum, zirconium, niobium, and mixtures thereof.

9. The light source of claim 1 wherein the filament includes a nonmetal.

10. The light source of claim 1 wherein the filament comprises a metal selected from the group consisting of tantalum carbide, rhenium carbide, niobium carbide, zirconium carbide and mixtures thereof.

11. The light source of claim 1 wherein the heating element essentially comprises tungsten.

12. The light source of claim 1 wherein the bulb includes an inner surface which includes a mirror coating.

13. The light source of claim 12 wherein the mirror coating comprises a dielectric multilayer coating.

14. The light source of claim 13 wherein the dielectric multilayer coating is spectrally selective so as to substantially reflect the heat radiation emitted by the filament while substantially transmitting the emitted visible light.

15. The light source of claim 1 wherein the bulb is at least partially filled with an inert gas and/or a halogen gas.

16. The light source of claim 1 wherein the bulb is at least partially filled with a halogen gas which contains bromine and/or iodine.

17. The light source of claim 1 wherein the filament and/or the heating element are coated with a coating material which has a higher melt temperature than the material upon which it is coated.

18. The light source of claim 17 wherein the coating material includes a carbide selected from the group consisting of tantalum carbide, rhenium carbide, niobium carbide, zirconium carbide, and mixtures thereof.

* * * * *